US007037097B2

(12) United States Patent
Wilkie et al.

(10) Patent No.: US 7,037,097 B2
(45) Date of Patent: May 2, 2006

(54) METHODS AND APPARATUS FOR CONTROLLING AIRFLOW IN A FIBER EXTRUSION SYSTEM

(75) Inventors: Arnold E. Wilkie, Merritt Island, FL (US); James Brang, Cocoa, FL (US); Angel Antonio De La Hoz, Melbourne, FL (US)

(73) Assignee: Hills, Inc., Melbourne, FL (US)

( * ) Notice: Subject to any disclaimer, the term of this patent is extended or adjusted under 35 U.S.C. 154(b) by 0 days.

(21) Appl. No.: 10/849,495

(22) Filed: May 20, 2004

(65) Prior Publication Data

US 2005/0008728 A1 Jan. 13, 2005

Related U.S. Application Data

(60) Provisional application No. 60/471,710, filed on May 20, 2003.

(51) Int. Cl.
*D01D 5/092* (2006.01)

(52) U.S. Cl. ..... 425/72.2; 425/382.2; 425/464

(58) Field of Classification Search ..... 425/72.2, 425/382.2, 464, 72.1
See application file for complete search history.

(56) References Cited

U.S. PATENT DOCUMENTS 3,062,611 A * 11/1962 Keen ..... 264/131
4,492,557 A * 1/1985 Ray et al. ..... 425/72.2
4,712,988 A * 12/1987 Broaddus et al. ..... 425/72.2
4,743,186 A * 5/1988 Schippers ..... 425/72.2
5,714,171 A * 2/1998 Profe ..... 425/66
5,814,349 A 9/1998 Geus et al.
5,935,512 A * 8/1999 Haynes et al. ..... 264/555
6,103,158 A * 8/2000 Schafer et al. ..... 264/103

* cited by examiner

*Primary Examiner*—Joseph S. Del Sole
(74) *Attorney, Agent, or Firm*—Edell, Shapiro & Finnan LLC

(57) ABSTRACT

An apparatus for controlling airflow in a fiber extrusion process includes a fiber flow region between an inlet through which extruded fibers are received and an outlet through which the extruded fibers are discharged and at least one surface providing a boundary between the fiber flow region and another region, wherein the surface includes apertures permitting air to flow between the fiber flow region and the other region to control airflow at the outlet of the fiber flow region. The apparatus can include a housing which contains at least one chamber, with the surface forming a boundary between the fiber flow region and the chamber, such that the apertures permit air to flow between the fiber flow region and at the chamber. In a spunbond process, the airflow control device receives drawn filaments exiting an aspirator and deposits the filaments onto a web-forming surface with reduced air disturbance.

36 Claims, 7 Drawing Sheets

METHODS AND APPARATUS FOR CONTROLLING AIRFLOW IN A FIBER EXTRUSION SYSTEM

CROSS REFERENCE TO RELATED APPLICATION

This application claims priority from U.S. Provisional Patent Application Ser. No. 60/471,710 entitled "A Modified Spun Bond Process Having Improved Fiber and Web Laydown, Greater Versatility and Improved Economics," filed May 20, 2003. The disclosure of this provisional patent application is incorporated herein by reference in its entirety.

BACKGROUND OF THE INVENTION

1. Field of the Invention

The present invention relates to methods and apparatus for controlling airflow in a fiber extrusion system and, more particularly, to an airflow control device capable of selectively separating, removing, or re-directing air present in the system to control the flow of the air and fibers in a desired manner.

2. Description of the Related Art

A great deal of development work has ensued since the initial development of the spunbond process in 1959 by DuPont. Much of that work has centered around uniform laydown of the melt spun fibers and properties of the spun web prior to bonding, such as loft or crimp. Additional development work has centered around the nature of the foraminous belt or drum collector, particularly when depositing the melt spun fibers onto solid or microporous substrates.

A schematic of a system 10 for performing a conventional spunbond process is shown in FIG. 1. Spunbond system 10 includes dual fiber extrusion apparatus for deposing fibers on a forming belt at two different locations. Each apparatus includes polymer extruders 12 for respectively melting pellets of two different polymer components (e.g., for forming bi-component fibers) prior to delivery to respective polymer filters 14. Melt pumps and corresponding drives 16 meter the molten polymer streams into spin beams 18, such that the molten polymer is received by spin packs 20 within the spin beams in a controlled manner. The molten polymer streams are distributed in the spin packs and extruded through a spinneret to form extruded fiber filaments 22 of selected cross-sectional geometric configurations.

Below the spinneret, quench air is blown onto the extruded filaments from the sides to at least partially quench the filaments, with some portion of the quench air being exhausted to the sides, as shown in FIG. 1. In each extrusion apparatus, the quenched fibers enter a high speed slot aspirator 24, which draws and attenuates the fibers using compressed air. A portion of the quench air and some of the surrounding ambient room air become entrained with the fibers as they flow from the spinneret into the aspirator. The extruded fibers exit the aspirator along with a substantial volume of entrained air, including air introduced in the aspirator. Upon exiting the aspirator, the drawn fibers are deposited as a web onto a foraminous surface 26 (e.g., a continuous screen belt) and are collected and/or subjected to further conventional or other processing treatments (e.g., bonding, heat treatment, etc.). A suction device 28 positioned below the foraminous surface draws in and exhausts a substantial portion of the air entrained with the filaments arriving at the foraminous surface. Compaction rolls 30 can be used to compact the web to form a loosely bonded fabric.

Optional meltblown beam(s) 32 can be used to deposit meltblown filaments in conjunction with or separate from the spunbond filaments. Typical bonding and finishing options include: calendar bonding, through-air bonding, chemical bonding, hydro-entangling, fiber splitting, needle punching, finish application, lamination, coating, and slitting and winding.

The system shown in FIG. 1 is a so-called open system. In some spunbond processes, the filament draw is primarily produced by the quench air which is forced along with the fibers into a draw slot below the quench (a so-called closed system). An example of such a system is disclosed in U.S. Pat. No. 5,814,349, the disclosure of which is incorporated herein by reference in its entirety.

In FIG. 1, the entrained air above the aspirator is due primarily to the quench air, the high speed filaments and the aspirator suction. Below the aspirator, the entrained air is due primarily to the high speed filaments and the high speed air exiting the aspirator as well as the high suction required through the foraminous belt. The problem of handling the large volume of compressed air, quench air and room air induced into the aspirator, and the entrained air from within the room below the aspirator, has been and remains a serious problem despite nearly fifty years of development to try to control the excess air. There is simply too much air causing substantial filament and fabric disturbance, especially in modem high spinning speed processes. In addition, excess suction is required through the foraminous collector to capture all this excess air. Accordingly, it would be desirable to control the airflow in extruded fiber processes, particularly at the point of depositing the fiber filaments on a forming surface or other collection device.

SUMMARY OF THE INVENTION

In accordance with the present invention, an apparatus for controlling the flow of air in a fiber extrusion process includes a fiber flow region between an inlet through which extruded fibers are received and an outlet through which the extruded fibers are discharged and at least one surface providing a boundary between the fiber flow region and another region, wherein the surface includes apertures permitting air to flow between the fiber flow region and the other region to control airflow at the outlet of the fiber flow region. The apparatus can include a housing which contains at least one chamber, with the surface being an internal surface that forms a boundary between the fiber flow region and the chamber. In a spunbond process, for example, the airflow control device can be positioned between the outlet of the aspirator and the web-forming surface (e.g., foraminous belt or drum). In this configuration, the airflow control device receives drawn filaments and process air from the aspirator at the inlet and discharges the filaments and remaining air, if any, at the outlet onto the web-forming surface. The housing may be positioned relative to the aspirator to form an air gap between the inlet and the aspirator, and the length of the air gap can be adjustable. Optionally, the width of the inlet and the width of the outlet can be adjustable.

The internal surface bounding the fiber flow region can include first and second walls, wherein at least one of the first and second walls includes the apertures. The internal walls can be planar, angled or curved (concave or convex) and can be substantially parallel, convergent, or divergent in the fiber flow direction, depending on the desired effect on airflow. Optionally, the angle or distance between the internal walls is adjustable. If chambers are within the device, they communicate with the fiber flow region via the two internal walls. Alternatively, instead of chambers, the apertures may communicate with flow passages, manifolds or the ambient environment. Optionally, only one of the internal walls includes apertures, and the walls may be positioned either symmetrically or asymmetrically with respect to the fiber flow direction.

The apertures can be distributed either uniformly or non-uniformly over the interior surface bounding the fiber flow region. For example, in one configuration in which the airflow is recycled by circulating between the chambers and the fiber flow region, the internal walls include apertures at an inlet end portion and an outlet end portion, but have a solid center portion without apertures. In general, the apertures can vary in at least one of shape, size, spacing, and distribution over the internal surface or may be uniform with respect to any or all of these attributes. In addition, a particular plate may have a mechanism wherein the size, spacing and distribution of the apertures in that plate can be selectively adjusted. For example, two adjacent plates may be moved relative to another so that apertures in one or the other or both can be positioned to effectively modify the size or shape of some or all of the combined openings, or even close the combined openings, etc. Dampers would be another mechanism for effecting the desired modifications.

If chambers are employed within the airflow control device, the chambers can include an external wall with an opening or vent that permits ingress or egress of air into or out of the chamber. For example, the opening in the external wall can be located toward the outlet end of the housing for ducting air into an exhaust passage or duct extending from the chamber. Another option is to place an opening or vent in the external wall near the inlet end of the housing to permit ingress of air into the chamber via the external wall, which is particularly useful in the aforementioned air recycling configuration. The chamber can also include a bottom surface adjacent the outlet of the housing. The bottom surface can be substantially solid (i.e., no apertures), or the bottom surface can include apertures in communication with the chamber to permit ingress or egress of air via the bottom surface.

By reducing the amount of entrained air in the fiber extrusion process, the airflow control device of the present invention can substantially reduce the suction typically required through the web-forming surface, which minimizes the criticality of the open area of the expensive forming wire while maximizing the capability of multi-laydowns, and the capability to make composites, even composites onto impervious or microporous substrates. Likewise, the device may reduce the energy costs required because of lower air handling and conditioning requirements, and the air can be recycled if economical. The airflow control device also considerably reduces the noise caused by open airflow.

The airflow control device also provides the versatility to control filament velocity in web formation independent of a filament spinning velocity. In general, improved web formation can be achieved, particularly at higher spinning speeds, due to reduced air disturbance and a smoother laydown of fibers onto the foraminous surface, and improved fiber orientation can be obtained.

In accordance with another aspect of the present invention, a method of controlling the flow of air in a fiber extrusion process includes: receiving extruded fibers at an inlet of an airflow control device; passing the extruded fibers through a fiber flow region of the airflow control device, wherein at least one surface provides a boundary between the fiber flow region and at least one other region; and discharging the extruded fibers through an outlet of the fiber control device, wherein the surface includes apertures permitting air to flow between the fiber flow region and the other region to control airflow at the outlet of the airflow control device.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

The following detailed explanations of FIGS. 2–10B and of the preferred embodiments reveal the methods and apparatus of the present invention. The present invention overcomes the aforementioned problems associated with excess air in fiber extrusion systems in an innovative and relatively low cost manner by introducing a device and methods for controlling airflow either by separating at least a portion of entrained air from extruded fibers or directing the airflow in a more controlled manner. The airflow control device controls the amount and velocity of air that is allowed to exit with the spun filaments into the fabric formation zone. This process allows for controlled recycling or other controlled handling of the bulk of the air. The device can also be adjusted to cause the high speed yarn filaments to decelerate to a substantially lower velocity before exiting into the fabric formation zone, and minimizing or even eliminating entrained air that is generated below the aspirator in the prior art.

Figure 1:
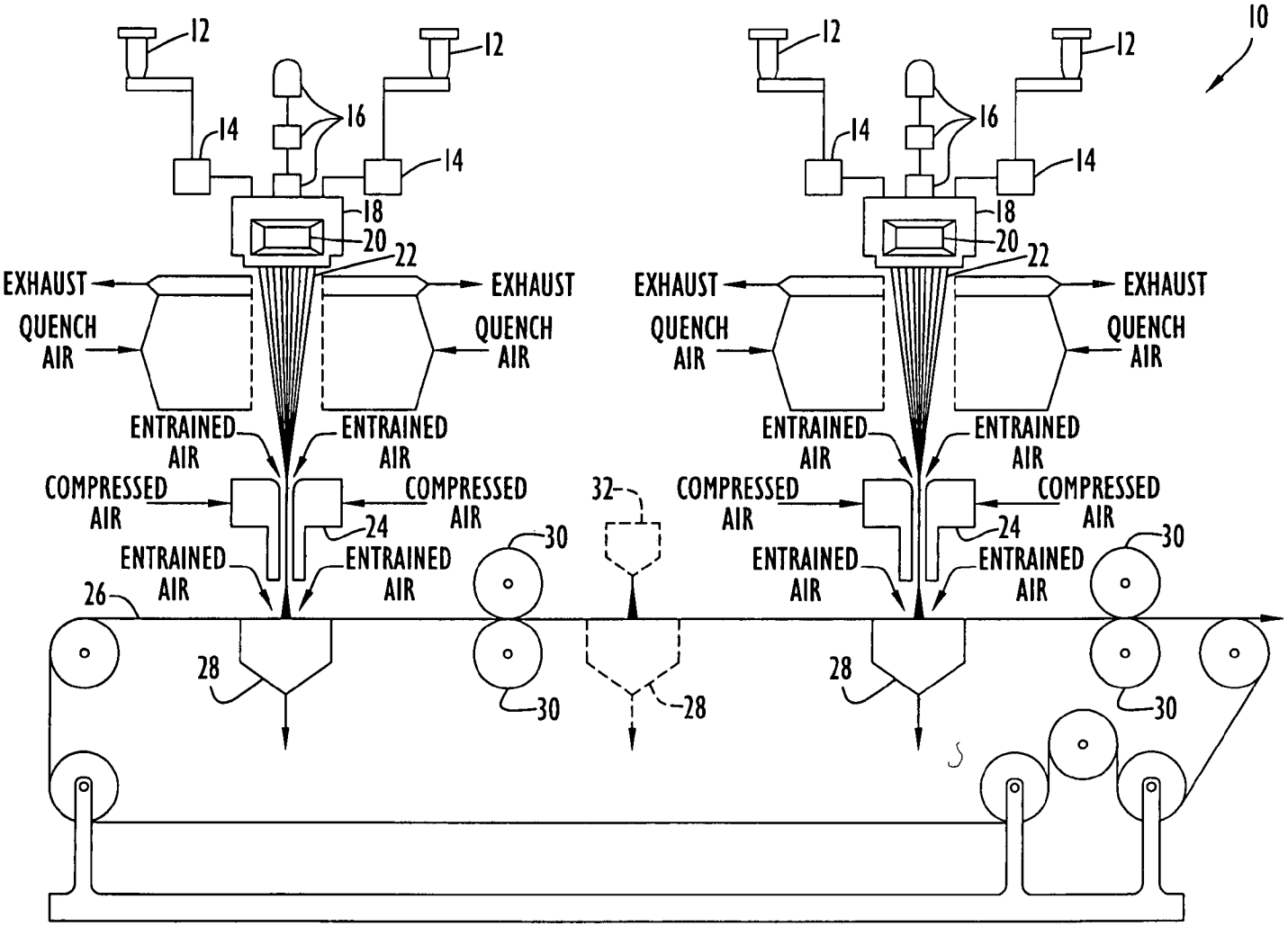
FIG. 1 PRIOR ART
FIG. 1 is a schematic diagram of a conventional system for producing spunbond fabric.
Figure 2:
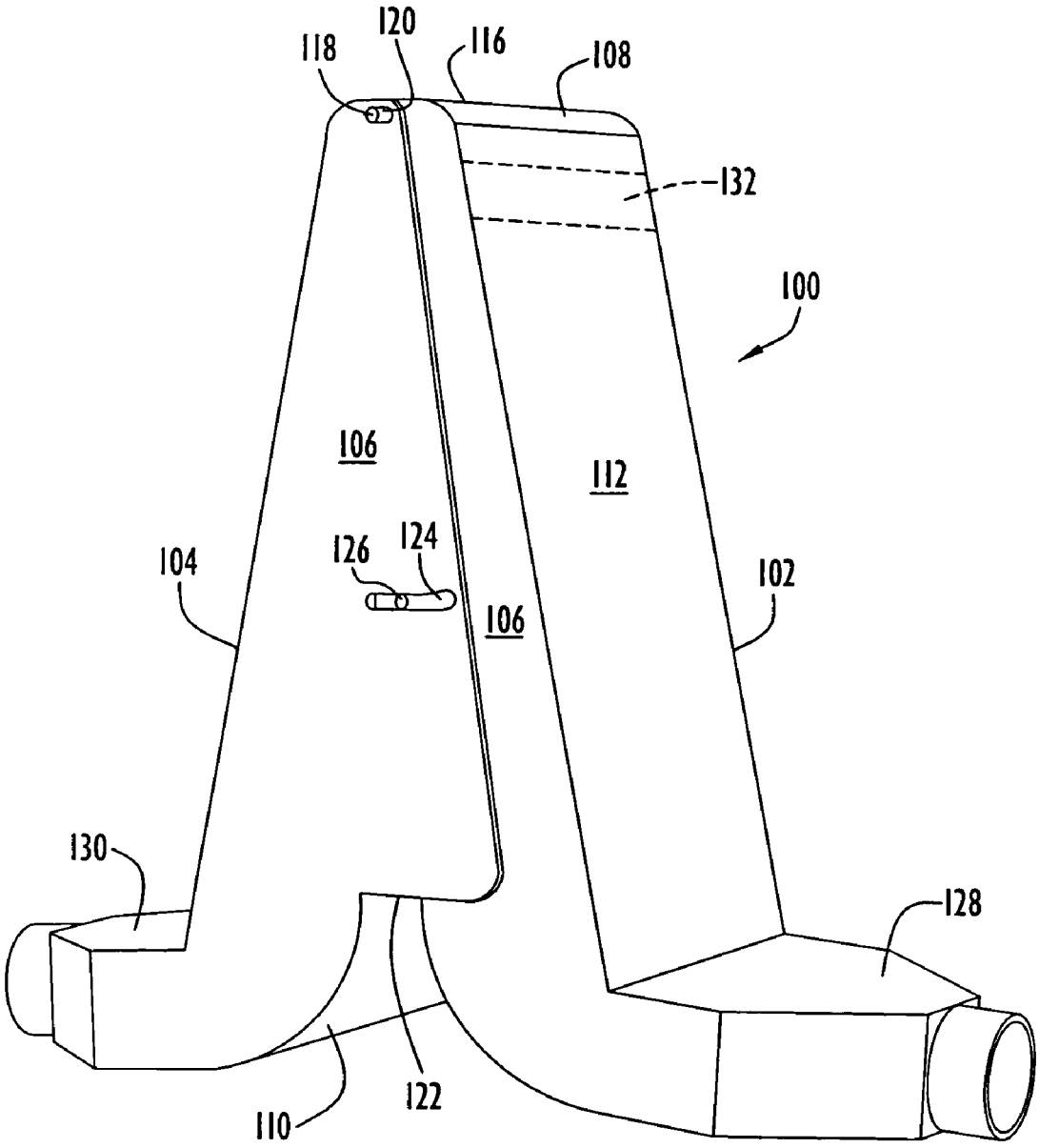
FIG. 2 is a perspective view of an airflow control device for controlling airflow in a fiber extrusion system in accordance with an exemplary embodiment of the present invention.

More particularly, a process and apparatus have been developed and demonstrated whereby the filaments exiting the aspirator are fed into an airflow control device upstream of the foraminous belt or drum. As shown in FIG. 2, an air control device according to an exemplary embodiment includes a housing having a generally inverted V-shape formed by two adjoined duct sections 102 and 104. Each duct section has a somewhat triangular cross-sectional shape in the machine direction (i.e., the direction along which the fibers travel on the foraminous belt) and a generally rectangular cross-sectional shape in the cross direction (i.e., the horizontal direction perpendicular to the machine direction). However, as will be seen in further embodiments, the duct sections are not limited to these cross-sectional shapes. The walls of the duct sections can be constructed, for example, from sheet metal or the like.

Figure 4:
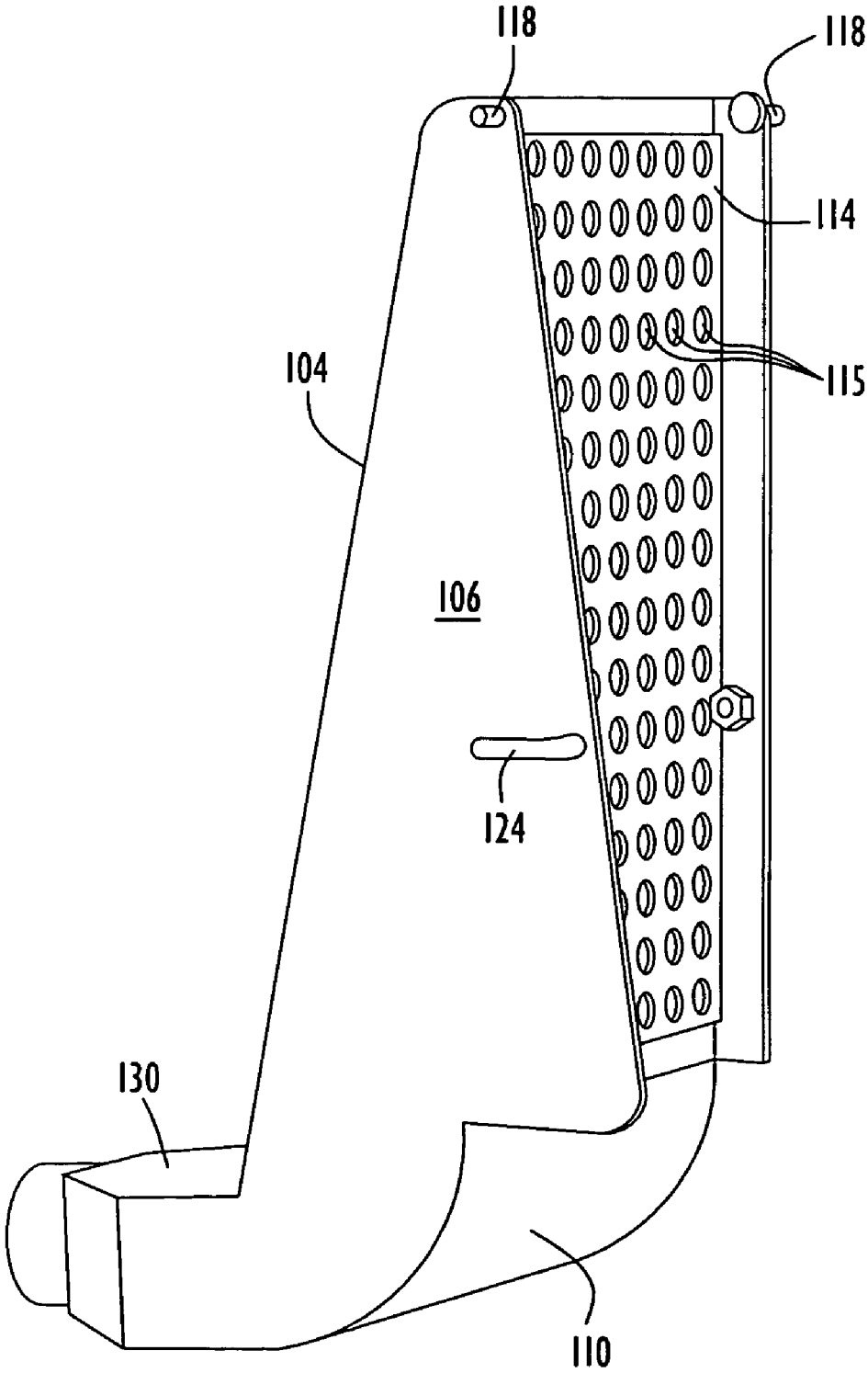
FIG. 4 is a perspective view of one duct section of the airflow control device showing an internal surface having apertures formed therein.

Each duct section is essentially a chamber for receiving air, with the chamber being bounded by external lateral side walls 106 (at the cross directional ends of the duct sections), a top wall 108, a bottom wall 110, an external back wall 112, and an internal wall or plate 114 (see FIG. 4). As will be described in greater detail, internal wall 114 includes perforations or apertures 115 for permitting airflow between the chamber and a fiber flow region within the airflow control device.

A slot-shaped inlet 116 is formed at the uppermost end of the housing by a gap or opening between duct sections 102 and 104 for receiving fibers exiting the aspirator. The elongated direction of the inlet slot is oriented in the cross direction to correspond to the shape of the curtain of fibers exiting a slot-shaped aspirator. The width of inlet 116 can be adjustable in the machine direction. For example, horizontal slots 118 and mating pins or bolts 120 respectively formed near the top of the lateral side walls 106 of the two duct sections 102 and 104 can be used to select the width of the inlet by sliding the pins or bolts 120 to the appropriate position within the slots 118. It will be appreciated that any of a variety of other mechanisms can be used to adjust or control the relative positions of the duct sections and the inlet and outlet widths.

A slot-shaped outlet 122 extending in the cross direction is formed between the two duct sections at the lower end of the housing, centered in the machine direction. Fibers entering the airflow control device via inlet 116 travel along the fiber flow region within the housing and exit the airflow control device via outlet 122. Preferably, the width of outlet 122 is adjustable. For example, arc-shaped slots 124 and mating pins or bolts 126 respectively formed on the lateral side walls 106 of the two duct sections 102 and 104 can be used to select the width of the outlet by sliding the pins or bolts 126 to the appropriate position within slots 124. As will be described in greater detail, the shape of the fiber flow region as well as the relative orientation of the internal walls 115 that bound the fiber flow region are affected by selection of the widths of the inlet and outlet via positioning of the respective pins and slots, which in turn impacts how the airflow control device handles incoming air. As used herein, the term "bound(s)" or "bounding" indicates that a surface or wall serves as at least a portion of or lies along a boundary of a region or like and does not necessarily suggest or require that surface completely surround or enclose a region or define the entire extent of the region.

At their lower ends, duct sections 102 and 104 can be coupled to respective exhaust ducts 128 and 130, which in certain configurations can be used to remove air separated from the fibers. Optionally, the amount of air flowing into the exhaust ducts can be controlled (e.g., by adjustable baffles), and in certain configurations the passage to the exhaust ducts can be completely blocked or the exhaust ducts can be eliminated entirely.

Optionally, air vents 132 can be located along the external back walls 112 of duct sections 102 and 104. Preferably, the air vents are adjustable to permit control of the amount of airflow therethrough, from a fully open position to fully closed position. In general, the air vents can be positioned at any locations that result in beneficial control of the airflow; however, in accordance with one exemplary embodiment described herein, the air vents are positioned near or at the top of the external back walls 112 of duct section 102 and 104, as shown in FIG. 2.

Figure 3:
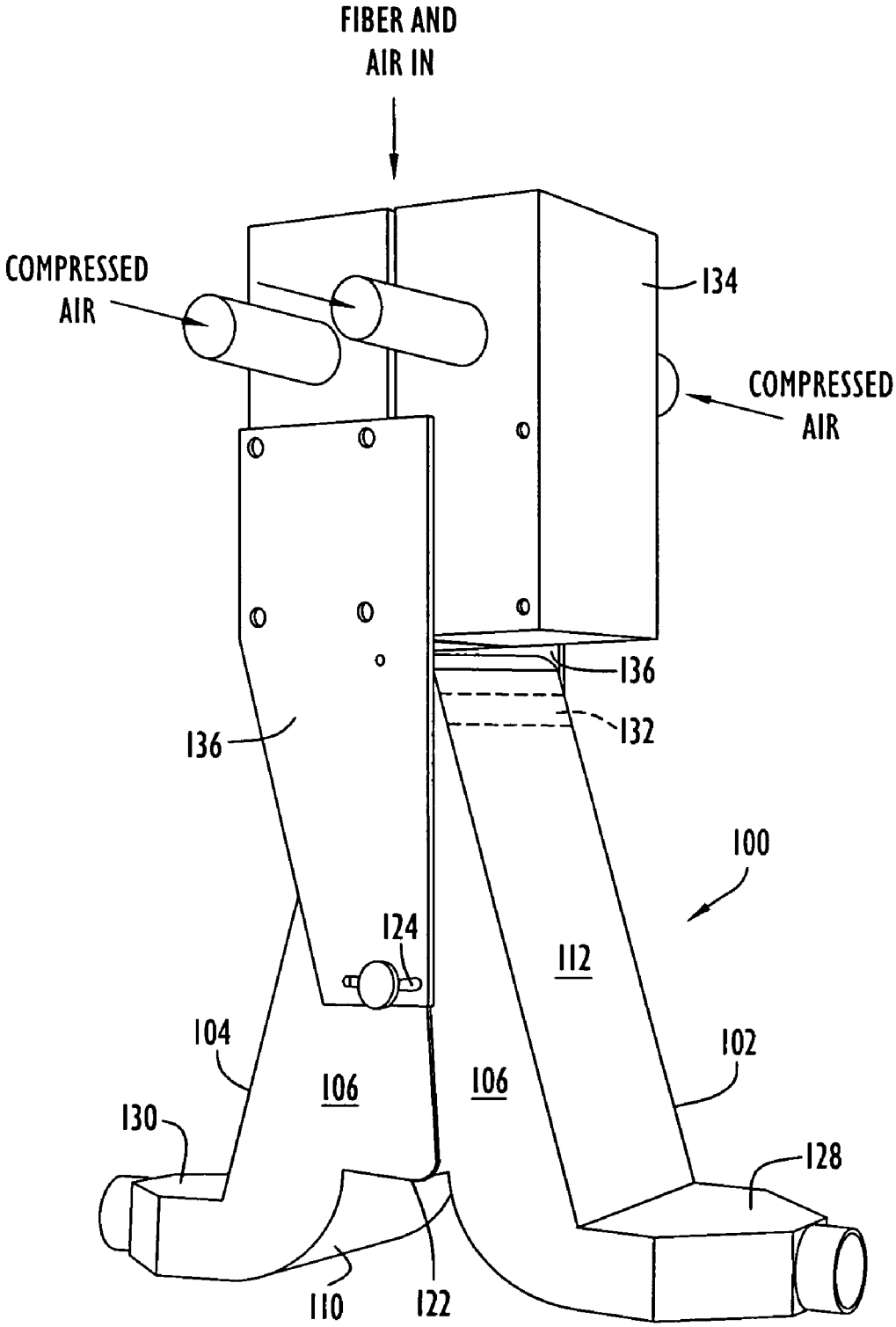
FIG. 3 is a perspective view of the exemplary airflow control device coupled to a compressed-air-powered slot aspirator.

FIG. 3 depicts the airflow control device 100 mounted below a compressed-air-powered slot aspirator 134 via mounting brackets 136 extending from aspirator 134, such that a vertical air gap exists between the outlet at the bottom of aspirator 134 and inlet 116 at the top of airflow control device 100. The length of the vertical air gap impacts the amount of entrained air that enters inlet 116 from aspirator 134, with a greater air gap generally reducing the amount of entrained entering the airflow control device. Preferably, the length of the air gap is adjustable, and optionally the air gap can be eliminated altogether, as will be shown in a particular configuration below.

The perforated internal wall 114 of duct section 104 is shown in FIG. 4 as a flat plate extending substantially parallel to the fiber flow direction, with equally-sized round apertures 115 arranged in regular rows and columns distributed uniformly over the plate. The internal walls of duct sections 102 and 104, along with portions of lateral side walls 106, bound the fiber flow region between the inlet and outlet, such that filaments flowing through the airflow control device do not enter the chambers in duct sections 102 and 104. As previously noted, the orientation of the internal walls 114 can be altered by selecting the width of the inlet and outlet of the airflow control device. Optionally, the orientation of internal walls 114 can also be adjusted independently of the inlet and outlet widths by altering the angle at which the internal walls are attached to the lateral side walls. For example, the internal walls may be rotated about a pivot point or attachable at multiple locations at the top and bottom along the lateral side walls.

The attributes of the apertures, including size, shape, spacing and distribution, are not limited to the configuration shown in FIG. 4, and the apertures need not be uniform with respect to any of these attributes. Thus, in general, the apertures need not have a uniform distribution across the internal walls 114, and the spacing, shape, and size may vary as desired or necessary to effect a certain airflow pattern. A significant consideration in this regard is the ratio of open area to closed area (or total wall surface) resulting from the size and spacing of the apertures and how this ratio may vary over the wall surface. The amount of open area is important, because it affects the pressure drop of the volume of air that passes through the device and significantly impacts the overall airflow control. While the internal wall 114 is shown in FIG. 4 as a substantially planar plate, the internal walls can be any internal surface having any suitable contour for producing a fiber flow region and chambers of a desired shape, including but not limited to curved surfaces and multiple planar surfaces at different angles. Moreover, the internal surfaces need not form a symmetric fiber flow region, and the internal walls can be positioned at different angles to yield an asymmetric fiber flow region and corresponding airflow, depending on the particular fiber laydown orientation sought.

A test airflow control device was constructed in accordance with the embodiment shown in FIGS. 2–4. The test airflow device stands approximately 16 inches in height and is approximately 6.5 inches wide (in the cross machine direction). The width of the outlet slot can be set on the order of 4 to 5 millimeters; however, it will be understood that the inlet and outlet widths are limited to any particular values. This particular airflow control device was operated on a small spunbond pilot line which produced fabric approximately 4 inches wide. For commercial spunbond lines which produce fabrics to greater than 4 meters wide, a similarly designed airflow control device can be used, with the cross-directional width slightly exceeding the width of the fabric produced. The airflow control device shown herein is only illustrative, and those skilled in the art will readily appreciate that alternative configurations and embodiments fall within the scope of the invention described. A number of configurations and variations will be described in connection with FIGS. 5–10B.

Figure 5:
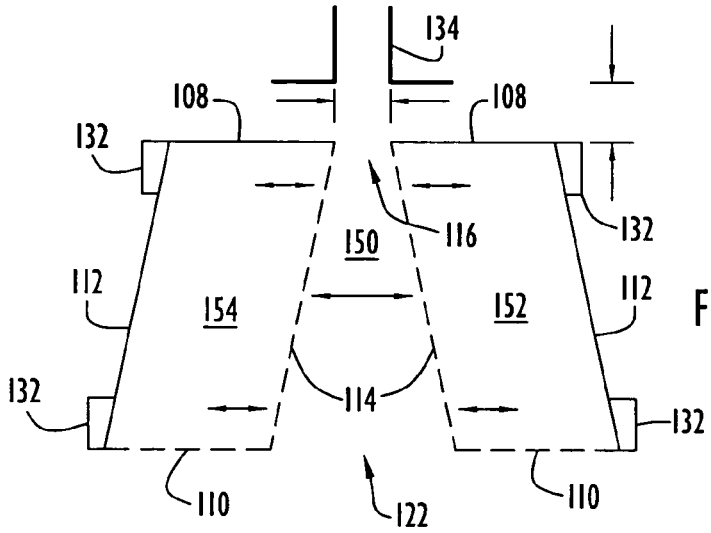
FIG. 5 is a diagrammatic cross-sectional side view of the airflow control device illustrating various options for positioning the components of the airflow control device.

For purposes of illustrating various options, components and configurations of the airflow control device, a diagrammatic cross-sectional side view of an exemplary airflow control device is shown in FIG. 5. Features shown in FIG. 5 are not necessarily to scale, but show the relationship and configurability of the various parts of the device. The speed at which fibers exit the airflow control device, the density and denier of the fibers, the laydown orientation of the fibers, and the amount and location of air exiting with the fibers can be controlled by varying the configuration of the airflow control device and its components. The fiber flow region 150 and two substantially symmetric airflow control chambers 152 and 154 can be seen in FIG. 5, with the internal walls 114 forming a boundary between the fiber flow region and the walls or chambers. Internal walls 114 are illustrated with dashed lines to indicate that at least some portion of the internal walls includes apertures permitting airflow between the fiber flow region and the chambers. The internal walls can have open area, solid area or combinations of both as required. Optionally, some portion or all of the bottom walls 110 of each chamber can also include apertures, as suggested by the dashed lines.

The external walls of the device, such as the external back walls 112 can also have open area, solid area or combination of both, as previously described. This feature is shown conceptually in FIG. 5 with optional air vents 132 located at the top (inlet end) and bottom (outlet end) of back walls 112. As previously described, lower air vents or openings would be useful where some portion of the airflow is exhausted via exhaust ducts, such as shown in FIGS. 2–4. Upper air vents or openings can be useful in configurations where air circulates through the chamber and is recycled into the fiber flow region. If advantageous in a particular configuration, air can either be forced or pumped out of the fiber flow region and into the chambers, if chambers are employed. Alternatively, air or other gaseous or vapor material may be forced or pumped into the fiber flow region via one or more apertures or air vents in any desired direction (e.g., transverse, downstream, upstream, or vectorial combinations thereof) relative to fiber flow through the device. The amount of air or other flow material admitted into the fiber flow region will depend upon the chemical or physical effects to be produced on the flowing fibers. Likewise, the nature of the inflowing material (e.g., air, other gas, vapor, etc., with or without additives) will depend upon the chemical or physical effects to be achieved on the flowing fibers.

As suggested by the arrows shown in FIG. 5, the length of the vertical air gap between inlet 116 and aspirator 134 can be a fixed distance or can be adjustable. The airflow control device can be attached below the aspirator slot (see FIG. 3) with or without a small air gap between the aspirator slot and the device inlet, or the air gap can be part of the airflow control device itself. The slot-shaped inlet can be adjusted to a desired width in the machine direction, such as in the manner described above, or the inlet width can be fixed. It should be noted that the device can be part of the aspirator structure, if desired, so that there would be no gap between the device and the aspirator.

While the internal walls 114 are shown as diverging in the fiber flow direction in FIG. 5, the internal walls can be arranged in parallel or in a converging orientation, and the distance between the internal walls optionally can be adjusted to get the desire air and fiber flow at the inlet and outlet (as suggested by the arrows shown in FIG. 5). If desirable for certain airflow control conditions, the internal walls can be arranged asymmetrically with respect to the fiber flow direction, resulting in an asymmetric fiber flow region and asymmetric chambers. This may be desirable where a particular machine direction/cross direction orientation is desired. According to another configuration, one of the internal walls can be solid (without apertures) and angled such that the fiber tend to flow toward the solid wall rather than the perforated wall. In this case, only one chamber is necessary, since air will not pass though the solid wall.

The setting of the internal plates (parallel, converging or diverging position) and the configuration of the chambers have a significant effect on the behavior of the flow (velocities, pressure zones, etc.), the amount of air coming into the process (reduce or prevent), the amount of air going out (to the foraminous belt, room, out of the process area, etc), and the amount of air being recycled within the chamber to the process. Since air is the tension media in the fiber laydown process, control of airflows provides a better control of the fiber tension, the fiber orientation, and the amount of air in the laydown.

In the configuration shown in FIG. 5 and the previous figures, there are two perforated internal walls between the fiber flow region and the chambers to either side. This configuration results from the fibers being arranged in a linear curtain as they exit the aspirator and approach the web-forming surface. In general, the internal walls can be an internal surface having any shape that is suitable to the extrusion process being performed. Thus, for example, the internal surface could be a single continuous wall having a conical, frusto-conical, cylindrical, polygonal, elliptical, convex, concave, or other shape as appropriate.

While the chambers within the airflow control device are beneficial in providing control over the air leaving the fiber flow region (tests conducted using two solid plates where no chambers existed were found to produce relatively little airflow control), it has nevertheless been found that at least some significant improvement in airflow control can be achieved by using a perforated surface that is not enclosed by a housing that forms a closed chamber. For example, two perforated plates (i.e., with apertures) bounding a fiber control region can yield substantially improved airflow control relative to conventional spunbond processes having no perforated plates or bounded fiber flow region. Thus, the minimum requirement for the airflow control device of the present invention is a fiber flow region between and inlet and outlet with at least one perforated surface (i.e., a surface with apertures) providing a boundary between the fiber flow region and at least one other region, where the apertures permit air to flow between the fiber flow region and the other region to control airflow at the outlet. An external housing then makes the "other" region into a partially or fully enclosed chamber with potentially greater airflow control options. Where the external housing is omitted, other mechanisms can be used to achieve greater airflow control, such as surfaces positioned near but not necessarily attached to the airflow control device or the positioning of separate suction devices near the exterior of the fiber flow region. For some applications, the "other" region may be the ambient environment in which the system is located.

Referring again to FIG. 5, the outlet 122 can have a fixed size or can be adjustable to a desired width in the machine direction (i.e., the spacing of the gap between the duct sections at the outlet). In a situation where substantially all of the air is removed from the fibers, the fibers may collect near the outlet or form a plug-like collection. In such a configuration, the surfaces of the outlet optionally can be spring loaded or otherwise actuated to maintain a controlled force against the filament collection or plug. Another option is to include adjustable speed driven roller(s) at or near the outlet. Yet another option is to form internal walls 114 using movable perforated belts having adjustable speed. Suction supplied from below the foraminous surface can be used in whole or part to pull the fibers from the airflow control device where substantially all of the air is removed from the fibers.

Figure 6:
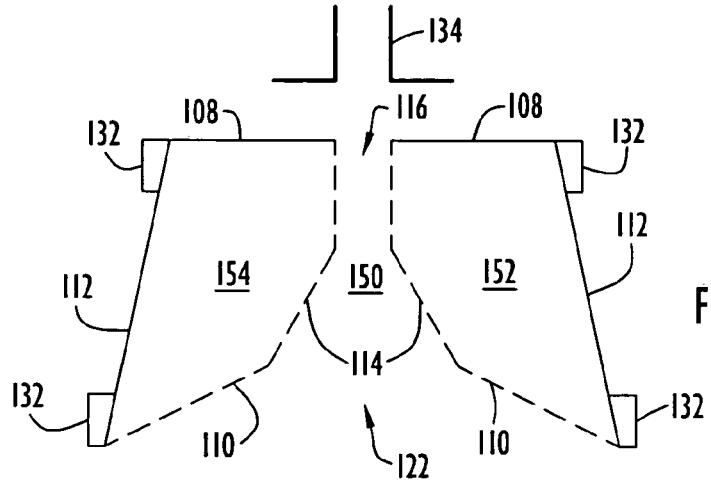
FIG. 6 is a diagrammatic cross-sectional side view of the airflow control device according to another embodiment of the present invention.
Figure 7:
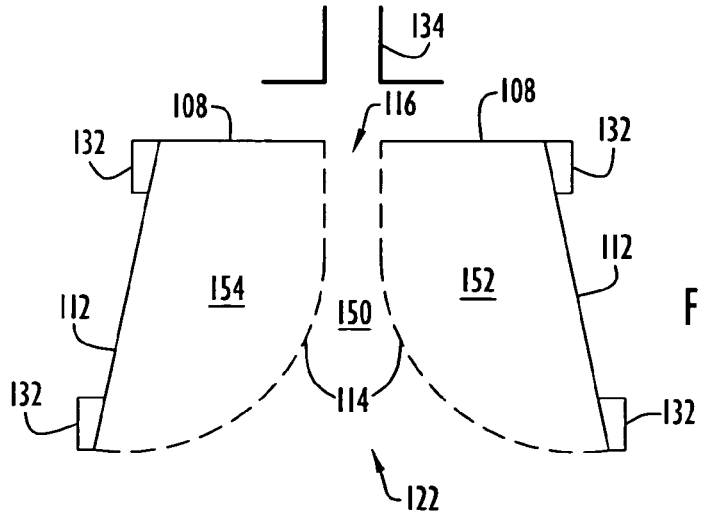
FIG. 7 is a diagrammatic cross-sectional side view of the airflow control device according to yet another embodiment of the present invention.

FIGS. 6 and 7 illustrate different configurations of the internal walls and bottom walls, where the internal walls are at different angles at different points in the fiber flow region. In FIG. 6, the internal walls comprise a series of planar surfaces at different angles. The uppermost segments of the internal walls (adjacent the inlet) are substantially parallel, while the segments extending from the uppermost segments are at a divergent angle in the fiber flow direction. These segments extend to the bottom walls 110, which are at a more divergent angle, but not entirely perpendicular to the fiber flow direction. In FIG. 7, the internal walls 114 are curved such that they diverge in the fiber flow direction and form continuous curved surfaces that include the bottom surfaces.

Figure 8:
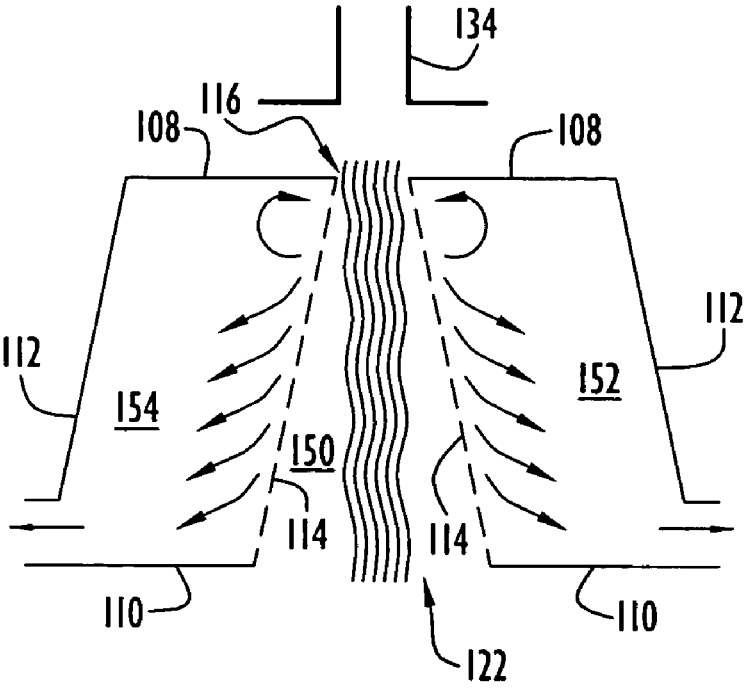
FIG. 8 is a diagrammatic cross-sectional side view of the airflow control device illustrating airflow in one configuration.

FIGS. 8–10A illustrate the air and fiber flows resulting from a number of representative configurations of the airflow control device of the present invention. In FIG. 8, duct sections 102 and 104 are configured with openings at the outlet end of the external back walls 112, with the openings leading to exhaust ducts in an arrangement similar to that shown in FIGS. 2–4. Internal walls 114 diverge in the fiber flow direction, with apertures distributed throughout the walls 114. An air gap exists between the device inlet 116 and the outlet slot of aspirator 134. In this configuration, most of the air entering the chambers via the apertures flows through the exhaust ducts and is removed from the process. Depending on the particular operational parameters and dimensions, spacings, angles, etc. of the various surfaces, a small amount of the air entering the chambers near the inlet may circulate and return to the fiber flow region. Due to the divergence of the internal walls 114, at least a portion of the air entering the device inlet travels through the fiber flow region and exits with the fibers at the outlet. The amount of air discharged from the outlet depends on the specific configuration of the airflow control device and the spunbond process. The filaments exit the airflow control device and are deposited onto the foraminous belt or drum in the form of an unbonded spun web, where the web is maintained on the moving belt or drum by a minimum amount of suction or other technique for holding the web on the foraminous collector. The unbonded web is transported by the moving foraminous surface to compaction and/or bonding stations, and ultimately to a winder or other collection device. Any air exiting the outlet can be drawn in and evacuated by the suction unit positioned below the foraminous belt.

Figure 9:
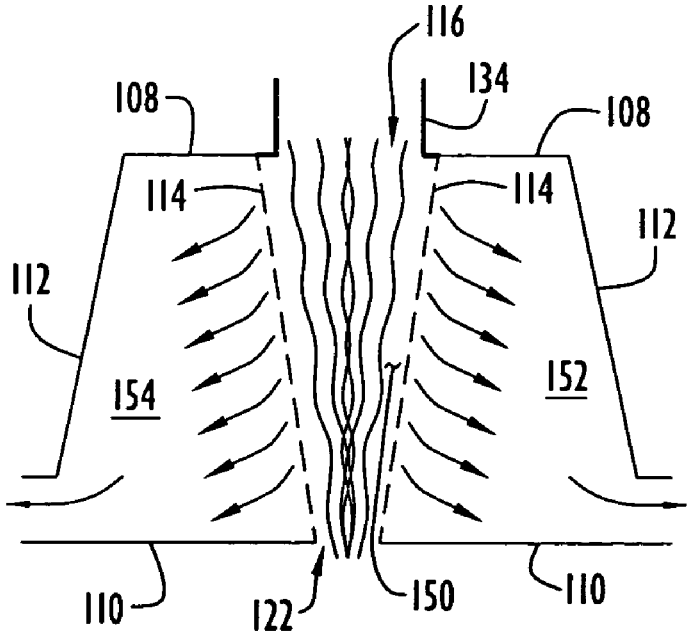
FIG. 9 is a diagrammatic cross-sectional side view of the airflow control device illustrating airflow in another configuration.

The arrangement shown in FIG. 9 differs from that in FIG. 8 in that internal walls 114 converge in the fiber flow direction, such that virtually all incoming air is diverted into the chambers and separated from the fibers. Additionally, the air gap between the inlet 116 and aspirator 134 has been eliminated entirely. Due to the minimal amount of air exiting the outlet in this configuration, the filaments are decelerated to a much lower speed at the outlet and may partially block the outlet, further causing the air to exit the fiber flow region via the chambers and exhaust ducts. Such air can then be ducted from the immediate area of the spinning section where it can be recycled or otherwise handled in a controlled manner. In this manner, airflow can be controlled such that the filaments exiting the aspirator are caused to decelerate and essentially form a loose collection or plug of filaments, impeding the flow of air downstream. The airflow control device can be designed so that as the fibers build up, they close off more and more of the apertures, causing an increase in pressure within the device, which eventually overcomes the frictional force holding the fibers. When this occurs, some amount of fibers will be pushed out of the device until there is no longer sufficient pressure inside the device to push additional filaments out. New fibers entering the fiber flow region will start to close off the apertures again, setting up a continuous process of fibers moving in and out of the device, simulating a pneumatic stuffer box texturing process.

In typical spunbond processes, the entrained air provides tension on the filaments as they are laid on the foraminous belt. Where substantially all of the air is separated from the fibers, as with parallel or converging plates, tension is instead provided by the fiber contacting the surfaces of the internal plates. Nevertheless, it may be desirable to allow at least some amount of air to exit the outlet to prevent development of a plug of fibers and to provide additional control of the fibers in the laydown process. This result can be achieved by adjusting the size of the outlet relative to the size/area of the apertures (or others of the aforementioned parameters) such that a desired volume of air remains with the fiber to maintain a continuous flow.

Figure 10A:
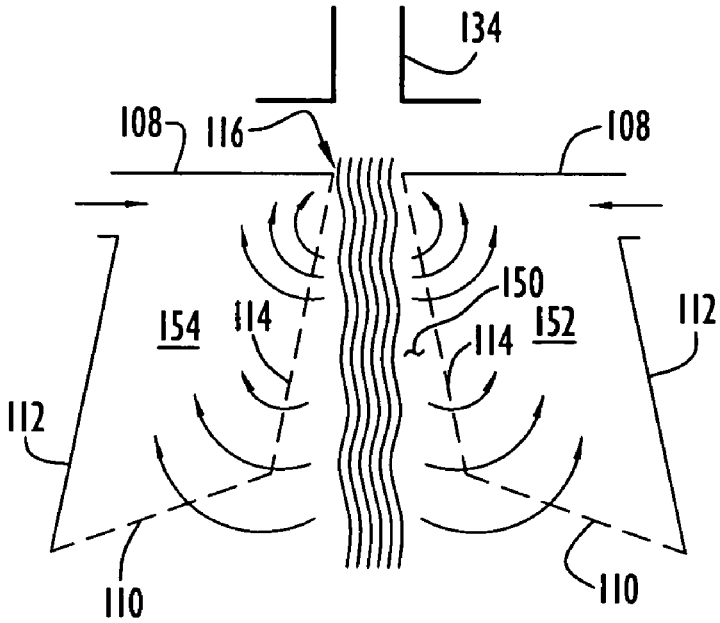
FIG. 10A is a diagrammatic cross-sectional side view of the airflow control device illustrating airflow in yet another configuration.
Figure 10B:
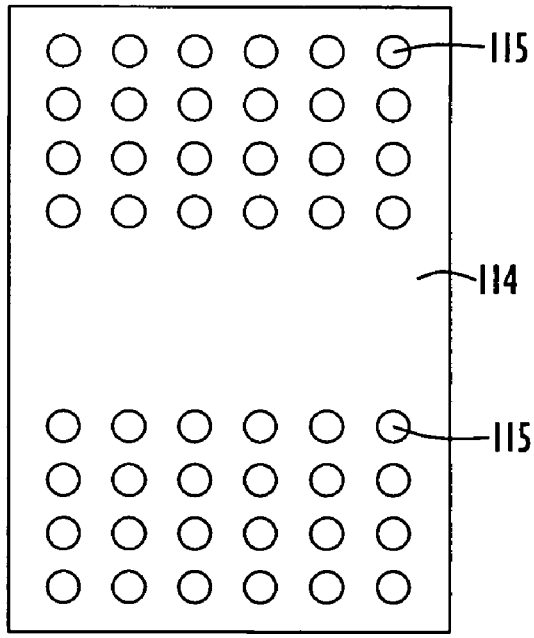
FIG. 10B is a front view in elevation of an internal plate of the airflow control device as configured in FIG. 10A, wherein the center portion of the plate is solid and apertures are formed in the plate at both the top and bottom end portions.

FIG. 10A illustrates a useful embodiment of the invention in which the advantages mentioned above related to handling and control of the air can be obtained by configuring the airflow control device to keep virtually all of the air in the system while controlling the airflow by re-circulating air through the chambers. As seen in FIG. 10A, external back walls 112 include air vents at the inlet end, allowing air to enter the chambers 152 and 154. This incoming air can aid in either accelerating or decelerating the main airflow in the fiber flow region and ultimately can impact the final fiber denier. Air vents or passages at the outlet end of the external back walls 112 are closed or eliminated entirely, such that little or no air is removed from the process via the side chambers. As shown in FIG. 10B, internal plates 115 include apertures at an inlet end portion and at an outlet end portion, but the center portion of each plate is substantially solid (no apertures or substantially fewer apertures). Bottom walls 110 are angled upward in the direction toward the fiber flow region 150 and optionally can include apertures to permit air to enter the chambers along the bottom of the device. In operation, air entering the chambers from the apertures (primarily from the lower apertures), flows upward within the chamber, mixes with room air entering via the vents, and reenters the fiber flow region via the upper apertures, resulting in a recycling of the airflow. The amount of airflow reentering the fiber flow region from the chambers can have a significant impact on fiber denier, since an incoming airflow near the inlet can accelerate the fiber flow speed while air flowing out of the fiber flow region near the inlet can decelerate the fiber flow speed, where a higher fiber flow speed could potentially reduce the resulting filament denier.

At the outlet end, the overall volume of air exiting the device remains substantial, since virtually no air is removed from the process via the chambers; however, the circulation and recycling of the airflow through the chambers results in a more manageable airflow pattern distributed in a controlled manner at the outlet and at the foraminous belt where the fiber web is formed. The shape of the chambers and the positioning of the apertures can be tailored to promote recycling of the airflow having a desired flow pattern. The divergent arrangement of the internal walls and the angling of the bottom walls provides more area at the bottom of the airflow control device to distribute air, which can be more smoothly suctioned into the table. The arrangement shown in FIG. 10A is also advantageous, because the airflow maintains tension on the fibers through the laydown process, thereby permitting a controlled laydown.

In general, good air balance allows better web formation, which is typically more difficult to achieve at high spinning speeds. Accordingly, the airflow control device of the invention can be particularly useful in improving airflow conditions in higher speed extrusion processes. The device can also be useful where a particular machine direction/cross direction (md/cd) web orientation is desired, since such orientation generally results from fiber flow conditions at the point of deposition on the foraminous surface. By controlling the airflow in a particular manner, a more precise md/cd ratio can be achieved.

In addition to overcoming the many problems associated with excessive amounts of compressed and entrained air in uniform laydown of the fibers/web during fabric formation, the invention has many other useful features. For example, by reducing the amount of entrained air in the process, the airflow control device can reduce or eliminate the suction required through the forming table or drum, which minimizes the criticality of the open area of the expensive forming wire, while maximizing the capability of multi-laydowns, and the capability to make composites, even composites onto impervious or microporous substrates. Further, in certain configurations, the device can greatly simplify the air handling system by reducing the problem of entrained room air. Likewise, the device may reduce the energy costs required because of lower air handling and conditioning requirements, and the air can be recycled if economical. The airflow control device also considerably reduces the noise caused by open airflow.

With respect to web formation, the invention provides the versatility to control filament velocity in web formation independent of a filament spinning velocity. In general, improved web formation can be achieved, particularly at higher spinning speeds, due to reduced air disturbance and a smoother laydown of fibers onto the foraminous surface, and improved fiber orientation can be obtained. The ability to separate a selected amount of air from the fibers allows the option to generate a zone of lower or no tension in the fibers for a finite residence time prior to web formation or fabric bonding. This provides the opportunity for several process/fabric enhancements including but not limited to: in-line development of crimp using bicomponent technology, the in-line application of heat or moisture (for various purposes including but not limited to inducing multi-component fibers to split into finer fibers), application of topical treatments, and controlled heat setting.

The airflow control device of the present invention has been described primarily in the context of an open spunbond system; however, the invention is not limited to this particular context. While the present invention is described by reference to an open system, it could be used equally well in a closed system. Further, the airflow control device can be configured for use in meltblown processes. A meltblown process differs from a spunbond process in that extruded polymer filaments, upon emerging from an extruder die, are immediately blown with a high velocity, heated medium (e.g., air) onto a suitable support surface. In contrast, extruded but substantially solidified filaments (e.g., utilizing a suitable quenching medium such as air) in a spunbond process are drawn and attenuated utilizing a suitable drawing unit (e.g., an aspirator or godet rolls) prior to being laid down on a support surface. Meltblown processes are typically utilized in forming fibers having diameters on a micron level, whereas spunbond processes are typically employed to produce fibers having normal textile dimensions.

The invention is not limited to processes where the fibers are immediately deposited on a surface to form a web. For example, the airflow control device can be used in systems where the extruded fibers (e.g., spunbond or meltblown) are wound up on a mandrel in the manufacture a cartridge filter or the like. Another option is to directly feed spunbond or meltblown fibers discharged from the airflow control device to a lapping machine to make a non-woven web with multiple layers of lapped web.

As noted above, air egressing via the apertures in the fiber flow region can be fed back into the region, either as a result of pressure differentials existing at different longitudinal flow locations adjacent the flowing fibers or by forcefully directing air back into the fiber flow region. He feedback air can be supplemented by additional air or other fluid before being fed back. In addition, whether or not egressing air is fed back, additional fluid can be delivered through the apertures into the fiber flow region to produce desired chemical and physical effects on the fibers. The additional fluid can be air, other gases, vapor, or any of these bearing an additive to produce the desired effects on the fibers. Additives my be used, for example, as drying agents, wetting agents, pH modifiers, coloring agents, etc. As also noted above, the direction of flow of fluid entering the fiber flow region via the apertures in the sidewalls can be transverse, upstream or downstream (or some vectorial combination thereof) relative to the fiber flow direction, again depending on the effects to be produced on the fibers.

Having described preferred embodiments of new and improved methods and apparatus for controlling airflow in a fiber extrusion system, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An apparatus for receiving extruded and drawn fibers discharged from an aspirator and for controlling the flow of air in a fiber extrusion process, comprising:

a fiber flow region between an inlet through which extruded and drawn fibers as well as air from the aspirator are received and an outlet through which the fibers are discharged;

at least one other region disposed adjacent the fiber flow region; and at least one surface providing a boundary between the fiber flow region and the at least one other region, wherein the at least one surface includes a plurality of apertures that permit air to flow between the fiber flow region and a common area within the at least one other region that is in communication with the plurality of apertures so as to control airflow at the outlet of the fiber flow region.

2. The apparatus of claim 1, wherein the at least one surface includes first and second walls, and wherein at least one of the first and second walls includes a plurality of apertures to permit air to flow between the fiber flow region into the common area within the at least one other region.

3. The apparatus of claim 2, wherein the first and second walls are substantially parallel.

4. The apparatus of claim 2, wherein the first and second walls converge in a direction of fiber flow.

5. The apparatus of claim 2, wherein the first and second walls diverge in a direction of fiber flow.

6. The apparatus of claim 2, wherein the angle or distance between the first and second walls is adjustable.

7. The apparatus of claim 2, wherein the first and second walls are substantially planar.

8. The apparatus of claim 2, wherein the first and second walls are curved surfaces.

9. The apparatus of claim 2, wherein only one of the first and second walls includes apertures.

10. The apparatus of claim 2, wherein the first and second walls are positioned asymmetrically with respect to a central axis of the fiber flow region corresponding with a direction of fiber flow.

11. The apparatus of claim 1, wherein the apertures are distributed non-uniformly over the at least one surface.

12. The apparatus of claim 1, wherein the apertures are distributed substantially uniformly over the at least one surface.

13. The apparatus of claim 1, wherein the apertures in the at least one surface vary in at least one of shape, size, spacing, and distribution over the at least one surface.

14. The apparatus of claim 1, wherein the apparatus is configured to deposit the fibers onto a foraminous surface to form a non-woven web.

15. The apparatus of claim 1, wherein the size of the inlet is adjustable.

16. The apparatus of claim 1, wherein the size of the outlet is adjustable.

17. The apparatus of claim 1, wherein the apparatus is a component of a spunbond system.

18. The apparatus of claim 1, wherein the apparatus is a component of a meltblown system.

19. The apparatus of claim 1, wherein the apparatus is configured to discharge fibers from the outlet for winding directly on a mandrel.

20. The apparatus of claim 1, wherein the apparatus is configured to supply fibers discharged from the outlet to a lapping machine.

21. The apparatus of claim 1, further comprising:

a housing including the inlet through which extruded fibers are received and the outlet through which the extruded fibers are discharged, wherein the housing is configured to prevent at least a portion of air that has passed from the fiber flow region to the at least one other region from returning to the fiber flow region.

22. The apparatus of claim 21, wherein the at least one surface includes first and second walls disposed at opposing sides of the fiber flow region, each of the first and second walls includes a plurality of apertures, and the at least one other region includes first and second chambers, wherein the first chamber is disposed adjacent and communicates with the apertures of the first wall and the second chamber is disposed adjacent and communicates with the apertures of the second wall.

23. The apparatus of claim 21, wherein the at least one other region includes an external wall with an opening that permits ingress or egress of air from the external wall.

24. The apparatus of claim 23, wherein the opening in the external wall permits ducting of air into an exhaust passage extending from the at least one other region.

25. The apparatus of claim 23, wherein the opening in the external wall is disposed toward an inlet end of the housing for permitting ingress of air into the at least one other region via the external wall.

26. The apparatus of claim 21, wherein the housing includes at least one bottom surface adjacent the outlet.

27. The apparatus of claim 26, wherein the at least one bottom surface includes apertures in communication with the at least one other region, the apertures permitting ingress or egress of air via the at least one bottom surface.

28. The apparatus of claim 26, wherein the at least one bottom surface is a solid surface.

29. The apparatus of claim 21, wherein the at least one surface includes apertures at an inlet end portion and an outlet end portion, the at least one surface further including a substantially solid center portion without apertures.

30. The apparatus of claim 29, wherein air circulates from the fiber flow region to the at least one other region via the apertures in the outlet end portion and circulates from the at least one other region to the fiber flow region via the apertures in the inlet end portion.

31. The apparatus of claim 21, wherein the housing is positioned to form an air gap between the inlet and the aspirator.

32. The apparatus of claim 31, wherein the length of the air gap is adjustable.

33. The apparatus of claim 1, wherein the apparatus is configured to facilitate the application of heat or moisture or other additive to the fibers in the fiber flow region or between the outlet of the fiber flow region and a web-forming surface.

34. The apparatus of claim 1, wherein the at least one other region is ambient environment in which the apparatus is located.

35. An apparatus for receiving extruded and drawn fibers discharged from an aspirator and for controlling the flow of air in a fiber extrusion process, comprising:

a fiber flow region between an inlet through which extruded and drawn fibers as well as air from the aspirator are received and an outlet through which the fibers are discharged; and means for permitting at least some of the air that has entered with the fibers at the inlet of the fiber flow region to flow between the fiber flow region and at least one other region disposed adjacent the fiber flow region via a plurality of apertures that provide communication between the fiber flow region and a common area within the at least one other region.

36. The apparatus of claim 35, further comprising:

means for minimizing or substantially preventing airflow at the outlet of the fiber flow region by preventing at least a portion of air that has passed from the fiber flow region to the at least one other region disposed adjacent the fiber flow region from returning to the fiber flow region.

* * * * *